US010710106B2

(12) United States Patent
Leedy

(10) Patent No.: US 10,710,106 B2
(45) Date of Patent: Jul. 14, 2020

(54) REPLACEMENT NOZZLE FOR AEROSOL CANISTER

(71) Applicant: Jack Leedy, Palm Bay, FL (US)

(72) Inventor: Jack Leedy, Palm Bay, FL (US)

( * ) Notice: Subject to any disclaimer, the term of this patent is extended or adjusted under 35 U.S.C. 154(b) by 0 days.

(21) Appl. No.: 16/290,390

(22) Filed: Mar. 1, 2019

(65) Prior Publication Data

US 2019/0270105 A1 Sep. 5, 2019

Related U.S. Application Data

(60) Provisional application No. 62/637,006, filed on Mar. 1, 2018.

(51) Int. Cl.
*B05B 11/00* (2006.01)

(52) U.S. Cl.
CPC ..... *B05B 11/0013* (2013.01)

(58) Field of Classification Search
CPC ..... B05B 11/0013
USPC ..... 222/402.13, 568, 397; 137/322
See application file for complete search history.

(56) References Cited

U.S. PATENT DOCUMENTS 1,500,986 A * 7/1924 Fish ..... F02M 61/02 239/533.6
1,751,129 A * 3/1930 Cocks ..... A47K 5/1211 222/95
3,169,670 A * 2/1965 Hrebenak ..... B65D 83/62 222/95
3,214,102 A * 10/1965 Meyer ..... B05B 15/528 239/107
3,775,792 A * 12/1973 Leonard ..... B23G 7/02 470/204
3,868,978 A * 3/1975 Knopf ..... B65D 83/42 141/19
5,022,151 A * 6/1991 Sorenson ..... B23P 15/00 29/890.143
5,154,356 A * 10/1992 Sorenson ..... B05B 15/658 239/550
5,894,964 A * 4/1999 Barnes ..... B65D 83/20 222/402.1
5,921,468 A * 7/1999 Palestrant ..... B05B 1/34 239/383

(Continued)

*Primary Examiner* — Patrick M. Buechner
*Assistant Examiner* — Michael J. Melaragno
(74) *Attorney, Agent, or Firm* — Daniel C. Pierron; Widerman Malek PL

(57) ABSTRACT

A replacement nozzle for an aerosol canister including a body section including a body channel and an exit aperture in fluidic communication with the body channel, a flange section including a flange channel positioned in fluidic communication with the body channel, and an attachment section including an attachment channel positioned in fluidic communication with the flange channel, an entry aperture positioned in fluidic communication with the attachment channel, and a thread positioned on an outer surface of the attachment section operable to removably attach the replacement nozzle to a stem of an aerosol canister. The attachment of the replacement nozzle enables depression of the stem of the aerosol canister resulting in expulsion of an aerosol comprised by the aerosol canister into the replacement nozzle through the entry aperture, through the attachment channel, through the flange channel, through the body channel, and exit from the replacement nozzle through the exit aperture.

18 Claims, 4 Drawing Sheets

(56) References Cited

U.S. PATENT DOCUMENTS

| | | | | |
|---|---|---|---|---|
| 5,927,611 | A * | 7/1999 | Palestrant | B05B 3/04 239/380 |
| 6,863,230 | B2 * | 3/2005 | Palestrant | B05B 1/3442 239/469 |
| 7,114,667 | B1 * | 10/2006 | Bontems | B05B 1/044 239/550 |
| 8,152,030 | B2 * | 4/2012 | Coroneos | B65D 83/207 137/322 |
| 9,903,406 | B2 * | 2/2018 | Hughes | F16B 25/106 |
| 10,371,193 | B2 * | 8/2019 | Hughes | F16B 25/0063 |
| 2008/0080953 | A1 * | 4/2008 | Wu | F16B 25/0015 411/412 |
| 2008/0230559 | A1 * | 9/2008 | Nardone | B65D 49/00 222/153.05 |
| 2011/0017780 | A1 * | 1/2011 | Coroneos | B65D 83/207 222/402.1 |
| 2011/0303705 | A1 * | 12/2011 | Coroneos | B65D 83/207 222/402.1 |

* cited by examiner

REPLACEMENT NOZZLE FOR AEROSOL CANISTER

RELATED APPLICATIONS

This application claims priority under 35 U.S.C. § 119(e) of U.S. Provisional Patent Application Ser. No. 62/637,006 filed on Mar. 1, 2018 and titled Replacement Nozzle for Aerosol Canister. The content of this application is incorporated herein by reference.

FIELD OF THE INVENTION

The present invention relates to replacement nozzles for aerosol canisters.

BACKGROUND OF THE INVENTION

One of the must vulnerable elements of disposable aerosol canisters is the nozzle. Designed for low cost, the nozzles are fabricated primarily out of plastic, making them susceptible to breakage. Once broken, an aerosol canister is rendered largely inoperable for its intended purpose of the directionally-controllable ejection of the aerosol contents of the aerosol canister.

Previous attempts at addressing the problem of replacing a broken aerosol canister nozzle have many shortcomings. Such solutions have, too, been fabricated out of plastic, leaving them vulnerable to the same types of breakage as the original nozzle. Moreover, the attachment between previous replacement nozzles and the aerosol canister have suffered from the inability to remove the replacement nozzle from the canister when the canister is empty, preventing reuse of the nozzle. Additionally, previous replacement nozzles have not allowed for control of the height of the replacement nozzle, hindering use of the canister once the replacement nozzle is attached.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the above in mind, embodiments of the present invention are related to a replacement nozzle for an aerosol canister comprising a body section comprising a body channel and an exit aperture in fluidic communication with the body channel, a flange section comprising a flange channel positioned in fluidic communication with the body channel, and an attachment section comprising an attachment channel positioned in fluidic communication with the flange channel, an entry aperture positioned in fluidic communication with the attachment channel, and a thread positioned on an outer surface of the attachment section operable to removably attach the replacement nozzle to a stem of an aerosol canister. The attachment of the replacement nozzle enables depression of the stem of the aerosol canister, such depression resulting in expulsion of an aerosol comprised by the aerosol canister into the replacement nozzle through the entry aperture, through the attachment channel, through the flange channel, through the body channel, and exit from the replacement nozzle through the exit aperture.

In some embodiments, the flange section may have an outer dimension that is greater than an outer dimension of the attachment section.

In some embodiments, the flange section may be attached to a lower portion of the body section and the attachment section may be attached to a lower portion of the flange section. Furthermore, the body section, the flange section, and the attachment section may be integrally formed as a single monolithic structure.

In some embodiments, the replacement nozzle may be fabricated from brass.

In some embodiments, the thread may be an external thread having characteristics of a pitch within a range from 0.04 inches to 0.05 inches, an angle within a range from 55 degrees to 65 degrees, a height within a range from 0.005 inches to 0.006 inches, a base width within a range from 0.0085 inches to 0.0095 inches, and a crest flat width within a range from 0.002 inches to 0.003 inches. In some embodiments, the thread may be an external thread having characteristics of a pitch of 0.045 inches, an angle of 60 degrees, a height of 0.0057 inches, a base width of 0.009 inches, and a crest flat width of 0.0025 inches.

In some embodiments, the attachment section may be tapered, such that a portion of the attachment section adjacent the flange section has an outer dimension that is greater than an outer dimension of a portion of the attachment section that is away from the flange section.

In some embodiments, the replacement nozzle may further comprise an intermediate section comprising an intermediate channel positioned in fluidic communication with each of the body channel and the flange channel, positioning the flange channel in fluidic communication with the body channel. Furthermore, the flange section may have an outer dimension that is greater than an outer dimension of the intermediate section. The intermediate section may be attached to a lower portion of the body section, the flange section may be attached to a lower portion of the intermediate section, and the attachment section may be attached to a lower portion of the flange section.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

An embodiment of the invention, as shown and described by the various figures and accompanying text, provides a replacement nozzle for aerosol canisters. The replacement nozzle may be operable to attach to a stem/straw comprised by the aerosol canister and facilitate controlled fluidic transfer from a reservoir of the aerosol canister to the environment around the aerosol canister in a directed spray as is known in the art. Such a replacement nozzle may be employed where a nozzle originally comprised by the aerosol canister has broken off or is otherwise removed from the aerosol canister.

Figure 1:
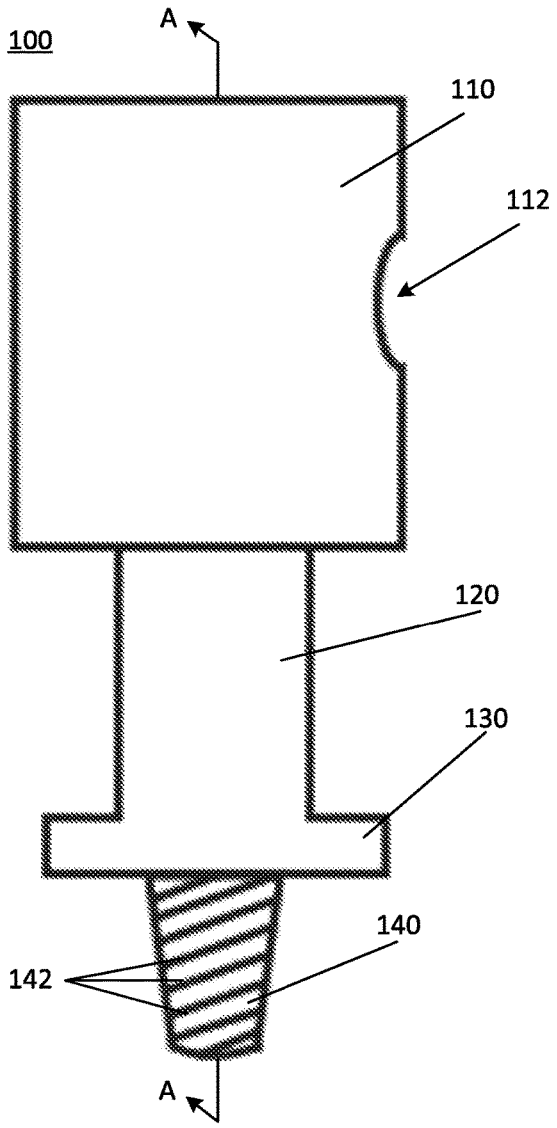
FIG. 1 is a side elevation view of a replacement nozzle according to an embodiment of the invention.
Figure 2:
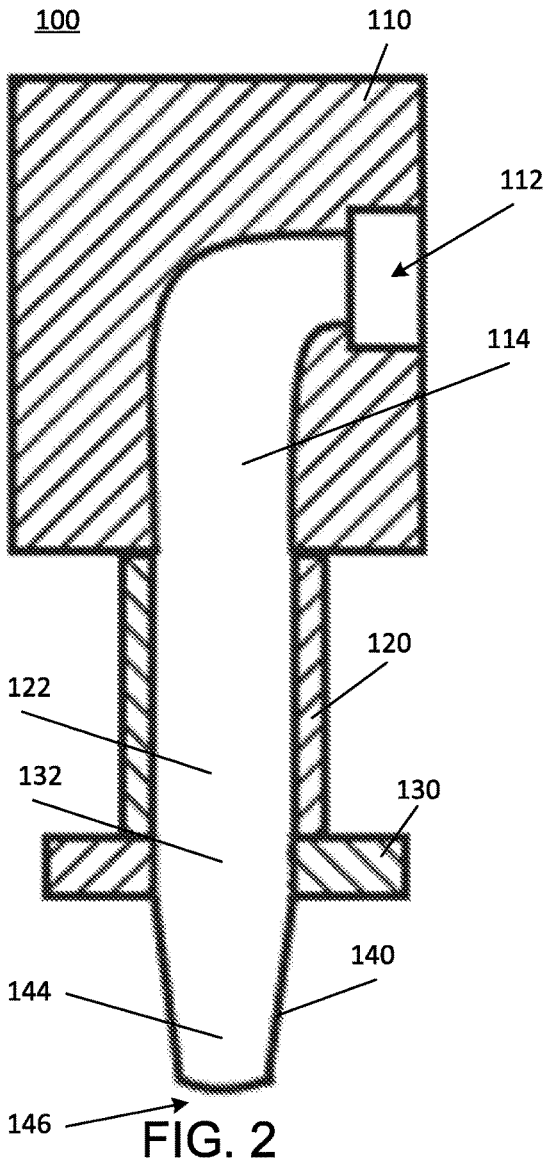
FIG. 2 is a side sectional view of the replacement nozzle of FIG. 1 taken through line A-A.

Referring now to FIGS. 1-2, a replacement nozzle 100 according to an embodiment of the invention is presented. The replacement nozzle 100 may comprise a body section 110, an intermediate section 120, a flange section 130, and an attachment section 140. In some embodiments, the entirety of the replacement nozzle 100 may be integrally formed as a single monolithic structure, for example, be milled from a single piece of material or formed by additive manufacturing and/or 3D printing. In other embodiments, one or more of the body section 110, the intermediate section 120, the flange section 130, and the attachment section 140 may be fabricated separately and attached to an adjacent structure of the replacement nozzle 100. Moreover, the replacement nozzle 100 may be fabricated from one or more materials, including, but not limited to, metals, metal alloys, polymers, ceramics, and the like. For example, the replacement nozzle 100 may be fabricated from brass.

The body section 110 may have any geometric configuration. In the present embodiment, the body section 110 may have a generally cylindrical configuration, such that a top-down view thereof would present a circle. Additionally, the body section 110 may be configured as a cylinder defined by a diameter of any size, such as within the range from 1 millimeter (mm) to 22 mm. In the present embodiment, the body section 110 may have a diameter of 11 mm. Additionally, the body section 110 may be configured to have as a cylinder defined by a height within the range from 1 mm to 24 mm. In the present embodiment, the body section 110 may have a height of 12 mm.

The body section 110 may comprise an exit aperture 112. The exit aperture 112 may be configured to permit an aerosol or other fluid to be expelled from the body section 110 through the exit aperture 112. The exit aperture 112 may be of any dimension and geometric configuration, including, but not limited to, ellipses and circles. For example, the exit aperture 112 may be defined as having a diameter within the range from 1 mm to 4 mm. In the present embodiment, the exit aperture 112 may have a diameter of 2 mm. Additionally, the exit aperture 112 may define a depth, i.e. a maximum distance from the side of the body section 110 within the range from 0.375 mm to 1.5 mm.

In the present embodiment, the exit aperture 112 may have a depth of 0.5 mm. The exit aperture 112 may be formed in a sidewall of the body section 110.

The body section 110 may further comprise a body channel 114. The body channel 114 may be configured to permit an aerosol or other fluid to traverse through an interior of the body section 110. Furthermore, the body channel 114 may be in fluidic communication with the exit aperture 112, thereby permitting the aerosol or other fluid traversing the body section 110 to be expelled from the body section 110 through the exit aperture 112. The body channel 114 may be configured to direct the flow of the aerosol or other fluid from where the aerosol or other fluid is received by the body channel 114 so as to have a desired exit profile when expelled through the exit aperture 112. In the present embodiment, the flow may be generally orthogonal to a plane defined by the exit aperture 112 and/or orthogonal to a side surface of the body section 110. Additionally, the portion of the body channel 114 adjacent to the exit aperture 112 may have an outer dimension that is less than an outer dimension of the exit aperture 112. More specifically, where both the body channel 114 and the exit aperture 112 have a circular geometric configuration, the diameter of the body channel 114 may be less than the diameter of the exit aperture 112.

The intermediate section 120 may be positioned adjacent and/or attached to a lower portion of the body section 110. The intermediate section 120 may comprise an intermediate channel 122 configured to permit an aerosol or other fluid to traverse through an interior of the intermediate section 120. Furthermore, the intermediate channel 122 may be positioned in fluidic communication with the body channel 114 such that the aerosol or fluid that traverses through the intermediate section 120 may flow into the body channel 114 and traverse through the body section 110.

The flange section 130 may be positioned adjacent and/or attached to a lower portion of the intermediate section 120. The flange section 130 may be generally spaced apart from body section 110 by the intermediate section 120. Taken in combination, the flange section 130, the intermediate section 120, and the body section 110 may extend generally upward from an aerosol canister the replacement nozzle 100 may be attached to and extend a distance away from the aerosol canister so as to facilitate usage of the aerosol canister by a user within the range from 5 mm to 22 mm. In the present embodiment, such a distance may be approximately 11.1 mm.

The flange section 130 may have an outer dimension that is greater than an outer dimension of at least one of the intermediate section 120 and a straw comprised by an aerosol canister. The flange section 130 may be configured to interface with the straw of the aerosol canister so as to facilitate depressing of the straw to cause aerosol or other fluid comprised by the aerosol canister to be expelled into the replacement nozzle 100. In some embodiments, the flange section 130 may have a generally circular geometric configuration defined by a diameter within the range from 5 mm to 22 mm. In the present embodiment, the flange section 130 may have a diameter of 11 mm.

Additionally, the flange section 130 may have a thickness configured to permit the application of sufficient force to the straw of the aerosol canister as described above to cause the expulsion of aerosol therefrom without plastic deformation thereof and with minimal elastic deformation thereof. Such a thickness will depend on the material used in forming the flange section 130. In the present embodiment, the flange section 130 may have a thickness of 1.5 mm.

The flange section 130 may comprise a flange channel 132 configured to permit an aerosol or other fluid to traverse through an interior of the flange section 130. Furthermore, the flange channel 132 may be positioned in fluidic communication with the intermediate channel 122 such that the aerosol or fluid that traverses through the flange section 130 may flow into the intermediate channel 122 and traverse through the intermediate section 120.

The attachment section 140 may be adjacent to and/or attached to a lower section of the flange section 130. The attachment section 140 may be configured to facilitate removable attachment to a straw or other structure of an aerosol canister. The attachment section 140 may comprise one or more external threads 142 on an outer surface thereof configured to interface with and/or cut a groove into the straw as the attachment section 140 traverses into the straw. Such interfacing and/or cutting into the straw may, in conjunction with the function of the flange section 130 described above, facilitate in the depressing of the straw to cause the release and expulsion of an aerosol or other fluid from the aerosol canister. In some embodiments, the interfacing between the attachment section 140 and the straw alone may be sufficient to enable application of sufficient force to cause the expulsion of the aerosol form the aerosol canister without any contribution from the flange section 130. Furthermore, the height of the replacement nozzle 100 relative to the aerosol canister to which it is attached may be altered by selectively rotating the replacement nozzle 100, thereby causing it to translate vertically from the resulting interaction between the threads 142 and the aerosol canister.

The attachment section 140 may comprise an attachment channel 144 configured to permit an aerosol or other fluid to traverse through an interior of the attachment section 140. Furthermore, the attachment channel 144 may be positioned in fluidic communication with the flange channel 132 such that the aerosol or fluid that traverses through the attachment section 140 may flow into the flange channel 132 and traverse through the flange section 130.

The attachment section 140 may comprise an entry aperture 146. The entry aperture 146 may be positioned in fluidic communication with the attachment channel 144 and permit an aerosol or other fluid to be expelled from the straw of the aerosol canister through the entry aperture 146 and into the attachment channel 144. The entry aperture 146 may have an outer dimension within the range from 0.5 mm to 2 mm. In the present embodiment, the entry aperture 146 has an outer dimension of approximately 1 mm. Additionally, while the entry aperture 146 may have any geometric configuration conforming to any polygon, the present embodiment has a circular geometric configuration.

The attachment section 140 may be generally tapered. More specifically, the portion of the attachment section 140 adjacent the flange section 130 may have an outer dimension that is greater than an outer dimension of a portion of the attachment section 140 generally from the flange section 130 and at an opposite end of the attachment section 140. In some embodiments, the outer dimension of an end the attachment section 140 adjacent the flange section 130 may be approximately twice the outer dimension of an end of the attachment section 140 away from the flange section 130. In the present embodiment, the outer dimension of the end of the attachment section 140 adjacent the flange section 130 is 3 mm, and the outer dimension of the attachment section 140 away from the flange section 130 is 1.5 mm. Those dimensions, however, may be within the range from 1.5 mm to 6 mm and 0.75 mm to 3 mm, respectively.

In some embodiments, each of the body channel 114, intermediate channel 122, and flange channel 132 may have approximately the same outer dimension, and where they all have a generally cylindrical configuration, the same diameter. In the present embodiment, the diameter may be approximately 1 mm.

Figure 3:
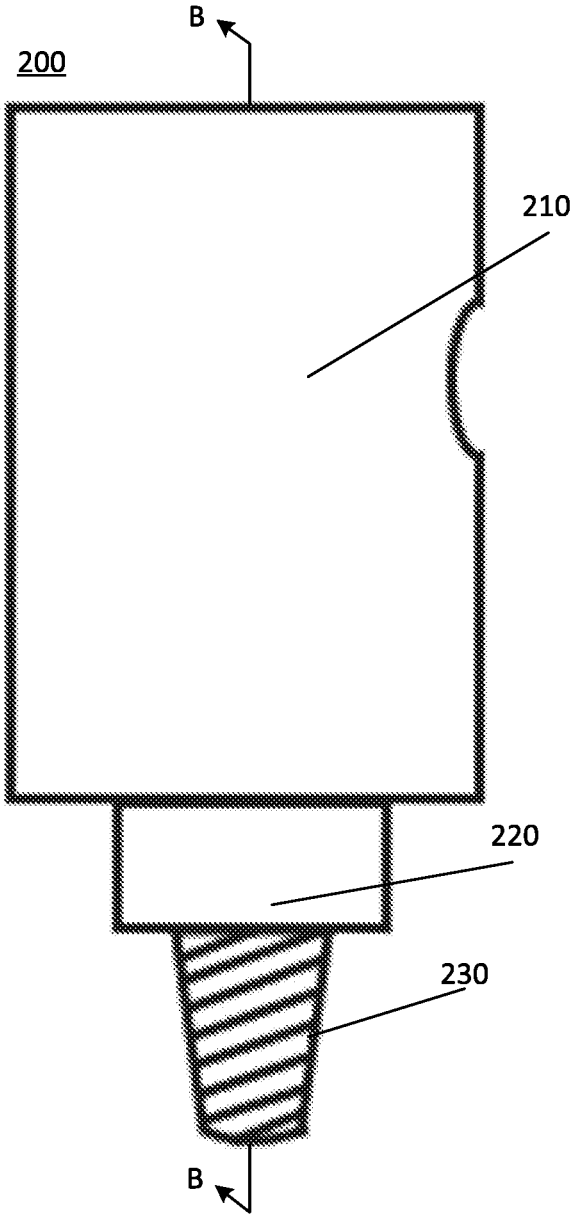
FIG. 3 is a side elevation view of a replacement nozzle according to an embodiment of the invention.
Figure 4:
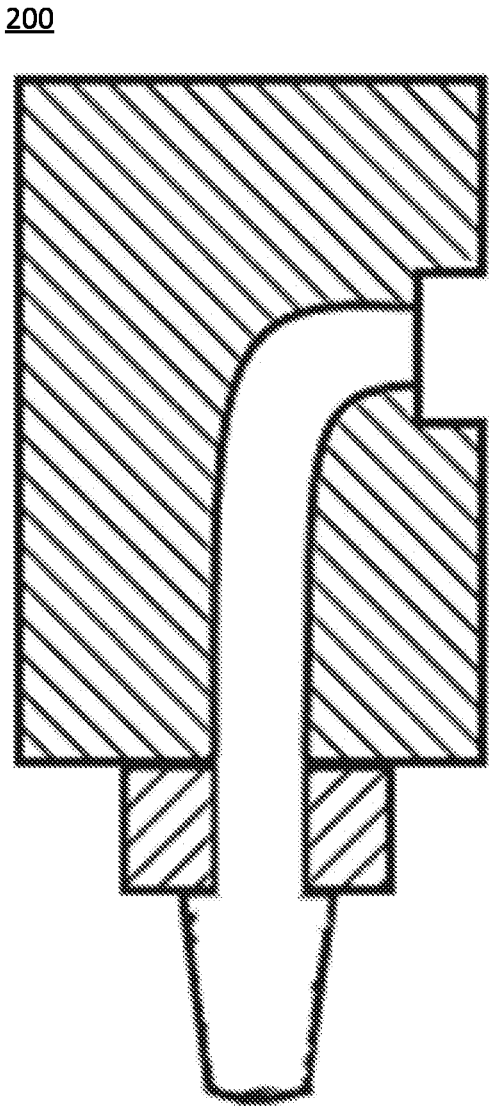
FIG. 4 is a side sectional view of the replacement nozzle of FIG. 3 taken through line B-B.

Referring now to FIGS. 3-4, a replacement nozzle 200 according to another embodiment of the invention is presented. The replacement nozzle 200 may comprise a body section 210, a flange section 220, and an attachment section 230. In the present embodiment, each of the body section 210 and the flange section 220 have been extended vertically so as to maintain the same vertical offset from an aerosol canister as described hereinabove without including an intermediate section. Otherwise, each section of the replacement nozzle 200 may operate generally identically to the replacement nozzle 100 of FIGS. 1-2.

Figure 5:
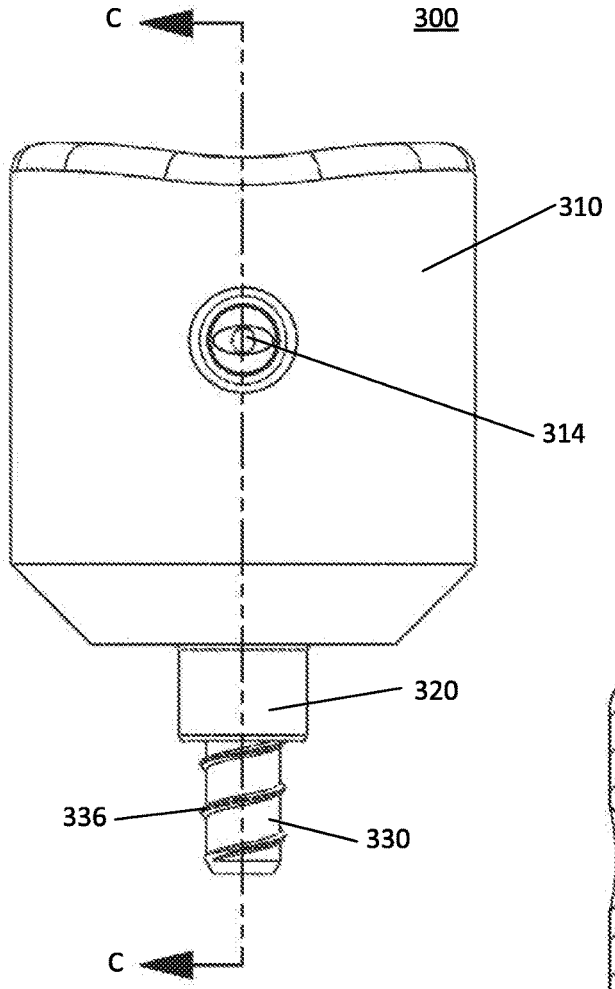
FIG. 5 is a front elevation view of a replacement nozzle according to an embodiment of the invention.
Figure 6:
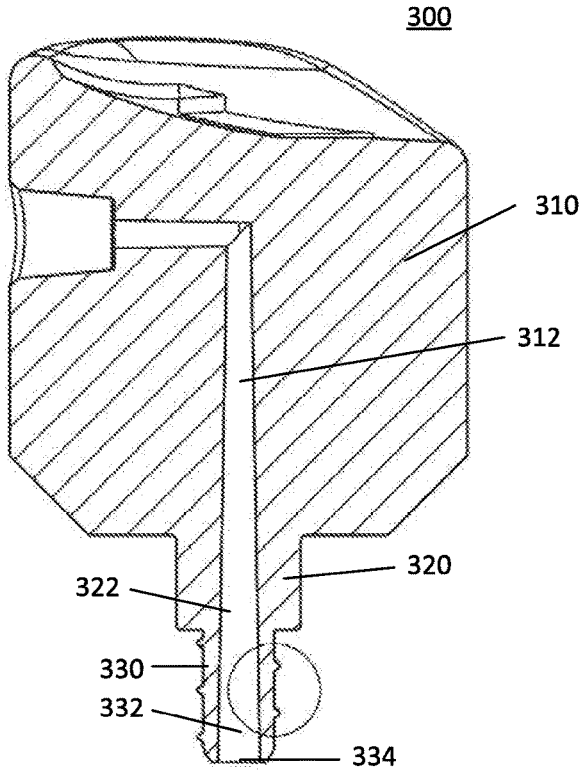
FIG. 6 is a side sectional view of the replacement nozzle of FIG. 5 taken through line C-C.
Figure 7:
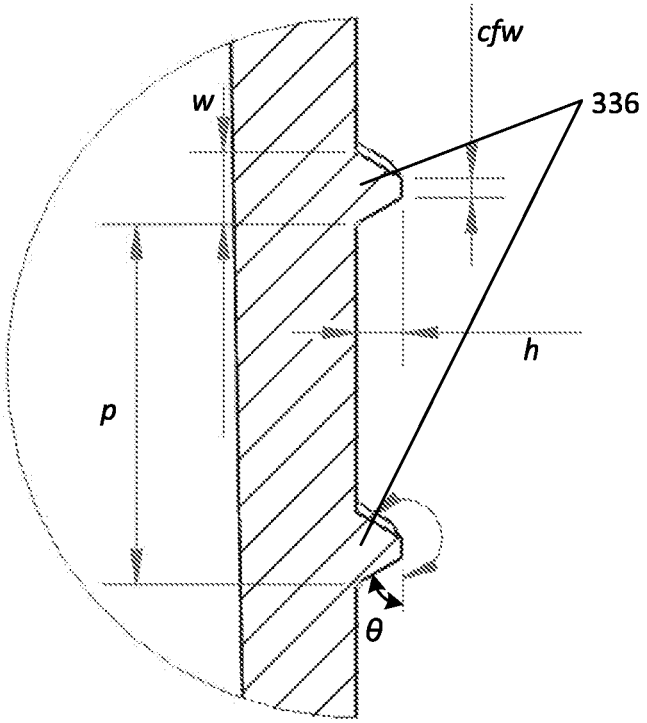
FIG. 7 is a partial side sectional view of an attachment section of the replacement nozzle of FIG. 5.

Referring now to FIGS. 5-7, a replacement nozzle 300 according to another embodiment of the invention is presented. The replacement nozzle 300 is similar to the replacement nozzle 200 of FIGS. 3-4, comprising a body section 310, a flange section 320, and an attachment section 330, respectively comprising a body channel 312, a flange channel 322, and an attachment channel 332. The body section 310 further comprises an exit aperture 314 and the attachment section 330 further comprises an entry aperture 334. In this embodiment, the attachment section 330 is not tapered, instead having a consistent outer dimension along its length.

The attachment section 330 further comprises a thread 336. The thread 336 may be any threading having characteristics configured to removably attach the replacement nozzle 300 to a stem of an aerosol canister. The thread 336 may have a pitch p within a range from 0.04 inches to 0.05 inches, a thread angle θ within a range from 55 degrees to 65 degrees, a height h within a range from 0.005 inches to 0.006 inches, a base width w within a range from 0.0085 inches to 0.0095 inches, and a crest flat width cfw within a range from 0.002 inches to 0.003 inches. In the present embodiment, the thread 336 is an external thread has a pitch p of 0.045 inches, a thread angle θ of 60 degrees, a height h of 0.0057 inches, a base width w of 0.009 inches, and a crest flat width cfw of 0.0025 inches. In some embodiments, the thread 336 may conform to the M3×0.5 standard thread size with a 0.045 inch separation.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus, the scope of the invention should be determined by the appended claims and their legal equivalents, and not by the examples given.

That which is claimed is:

1. A replacement nozzle for an aerosol canister comprising:

a body section comprising a body channel and an exit aperture in fluidic communication with the body channel;

a flange section comprising a flange channel positioned in fluidic communication with the body channel; and an attachment section comprising:

an attachment channel positioned in fluidic communication with the flange channel;

an entry aperture positioned in fluidic communication with the attachment channel; and an external thread positioned on an outer surface of the attachment section operable to removably attach the replacement nozzle to a stem of an aerosol canister, the thread having the characteristics of:

a pitch within a range from 0.04 inches to 0.05 inches;

an angle within a range from 55 degrees to 65 degrees;

a height within a range from 0.005 inches to 0.006 inches;

a base width within a range from 0.0085 inches to 0.0095 inches; and a crest flat width within a range from 0.002 inches to 0.003 inches;

wherein the attachment of the replacement nozzle enables depression of the stem of the aerosol canister, such depression resulting in expulsion of an aerosol comprised by the aerosol canister into the replacement nozzle through the entry aperture, through the attachment channel, through the flange channel, through the body channel, and exit from the replacement nozzle through the exit aperture.

2. The replacement nozzle of claim 1 wherein the flange section has an outer dimension that is greater than an outer dimension of the attachment section.

3. The replacement nozzle of claim 1 wherein:

the flange section is attached to a lower portion of the body section; and the attachment section is attached to a lower portion of the flange section.

4. The replacement nozzle of claim 3 wherein the body section, the flange section, and the attachment section are integrally formed as a single monolithic structure.

5. The replacement nozzle of claim 1 wherein the replacement nozzle is fabricated from brass.

6. The replacement nozzle of claim 1 wherein the thread is an external thread having characteristics of:

a pitch of 0.045 inches;

an angle of 60 degrees;

a height of 0.0057 inches;

a base width of 0.009 inches; and a crest flat width of 0.0025 inches.

7. The replacement nozzle of claim 1 wherein the attachment section is tapered, such that a portion of the attachment section adjacent the flange section has an outer dimension that is greater than an outer dimension of a portion of the attachment section that is away from the flange section.

8. The replacement nozzle of claim 1 further comprising an intermediate section comprising an intermediate channel; wherein the intermediate channel is positioned in fluidic communication with each of the body channel and the flange channel, positioning the flange channel in fluidic communication with the body channel.

9. The replacement nozzle of claim 8 wherein the flange section has an outer dimension that is greater than an outer dimension of the intermediate section.

10. The replacement nozzle of claim 8 wherein:

the intermediate section is attached to a lower portion of the body section;

the flange section is attached to a lower portion of the intermediate section; and the attachment section is attached to a lower portion of the flange section.

11. A replacement nozzle for an aerosol canister comprising:

a body section comprising a body channel and an exit aperture in fluidic communication with the body channel;

a flange section comprising a flange channel positioned in fluidic communication with the body channel; and an attachment section comprising:

an attachment channel positioned in fluidic communication with the flange channel;

an entry aperture positioned in fluidic communication with the attachment channel; and an external thread positioned on an outer surface of the attachment section operable to removably attach the replacement nozzle to a stem of an aerosol canister, the thread having the characteristics of:

a pitch within a range from 0.04 inches to 0.05 inches;

an angle within a range from 55 degrees to 65 degrees;

a height within a range from 0.005 inches to 0.006 inches;

a base width within a range from 0.0085 inches to 0.0095 inches; and a crest flat width within a range from 0.002 inches to 0.003 inches;

wherein the attachment of the replacement nozzle enables depression of the stem of the aerosol canister, such depression resulting in expulsion of an aerosol comprised by the aerosol canister into the replacement nozzle through the entry aperture, through the attachment channel, through the flange channel, through the body channel, and exit from the replacement nozzle through the exit aperture;

wherein the flange section has an outer dimension that is greater than an outer dimension of the attachment section; and wherein the replacement nozzle is fabricated from brass.

12. The replacement nozzle of claim 11 wherein:

the flange section is attached to a lower portion of the body section; and the attachment section is attached to a lower portion of the flange section.

13. The replacement nozzle of claim 12 wherein the body section, the flange section, and the attachment section are integrally formed as a single monolithic structure.

14. The replacement nozzle of claim 11 wherein the thread is an external thread having characteristics of:

a pitch of 0.045 inches;

an angle of 60 degrees;

a height of 0.0057 inches;

a base width of 0.009 inches; and a crest flat width of 0.0025 inches.

15. The replacement nozzle of claim 11 wherein the attachment section is tapered, such that a portion of the attachment section adjacent the flange section has an outer dimension that is greater than an outer dimension of a portion of the attachment section that is away from the flange section.

16. The replacement nozzle of claim 11 further comprising an intermediate section comprising an intermediate channel; wherein the intermediate channel is positioned in fluidic communication with each of the body channel and the flange channel, positioning the flange channel in fluidic communication with the body channel.

17. The replacement nozzle of claim 16 wherein:

the intermediate section is attached to a lower portion of the body section;

the flange section is attached to a lower portion of the intermediate section; and the attachment section is attached to a lower portion of the flange section.

18. A replacement nozzle for an aerosol canister comprising:

a body section comprising a body channel and an exit aperture in fluidic communication with the body channel;

a flange section comprising a flange channel positioned in fluidic communication with the body channel; and an attachment section comprising:

an attachment channel positioned in fluidic communication with the flange channel;

an entry aperture positioned in fluidic communication with the attachment channel; and a thread positioned on an outer surface of the attachment section operable to removably attach the replacement nozzle to a stem of an aerosol canister, the thread having the characteristics of:

a pitch within a range from 0.04 inches to 0.05 inches;

an angle within a range from 55 degrees to 65 degrees;

a height within a range from 0.005 inches to 0.006 inches;

a base width within a range from 0.0085 inches to 0.0095 inches; and a crest flat width within a range from 0.002 inches to 0.003 inches;

wherein the attachment of the replacement nozzle enables depression of the stem of the aerosol canister, such depression resulting in expulsion of an aerosol comprised by the aerosol canister into the replacement nozzle through the entry aperture, through the attachment channel, through the flange channel, through the body channel, and exit from the replacement nozzle through the exit aperture; and wherein the body section, the flange section, and the attachment section are integrally formed as a single monolithic structure.

* * * * *